United States Patent [19]

Bolduc et al.

[11] Patent Number: 4,766,365

[45] Date of Patent: Aug. 23, 1988

[54] SELF-REGULATED TRANSFORMER-INDUCTOR WITH AIR GAPS

[75] Inventors: Léonard Bolduc, Sainte-Julie; Grégoire Pare, Montarville, both of Canada

[73] Assignee: Hydro Quebec, Montreal, Canada

[21] Appl. No.: 75,759

[22] Filed: Jul. 20, 1987

[30] Foreign Application Priority Data

Apr. 15, 1987 [CA] Canada ..... 534843

[51] Int. Cl.[4] ..... G05F 3/06

[52] U.S. Cl. ..... 323/308; 323/331; 323/334; 336/155; 336/178

[58] Field of Search ..... 323/249, 250, 251, 308, 323/310, 329, 331, 332, 334; 363/75, 82, 90, 91, 93; 336/155, 160, 165, 178, 186

[56] References Cited

U.S. PATENT DOCUMENTS

| | | | |
|---|---|---|---|
| 2,765,436 | 10/1956 | Dornhoefer | 363/93 |
| 2,827,565 | 3/1958 | Weil | 323/251 |
| 3,253,212 | 5/1966 | Wentworth | 323/329 |
| 3,447,068 | 5/1969 | Hart | 323/308 |
| 4,041,431 | 10/1977 | Enoksen | 336/160 |
| 4,156,222 | 5/1979 | Rossman et al. | 336/155 |
| 4,378,522 | 3/1983 | Suladze et al. | 323/334 |

*Primary Examiner*—Patrick R. Salce
*Assistant Examiner*—Anita M. Ault
*Attorney, Agent, or Firm*—Foley & Lardner, Schwartz, Jeffery, Schwaab, Mack, Blumenthal & Evans

[57] ABSTRACT

The transformer comprises a three-limbed magnetic core having two outer limbs each defining a central air gap. Two windings, an alternating current one and a direct current one, are wound around each outer limb. Primary and secondary windings are disposed on the center limb, the primary one being supplied with alternating current from a source, and the secondary one supplying with alternating current an external load. The two alternating current windings are connected in series and supplied with alternating current by the source, possibly through an additional winding wound around the center limb, while the two direct current windings are connected in series and supplied by the current in the alternating current windings rectified through a diode bridge. The current in the two direct current windings induces a magnetic flux in a closed circuit defined by the outer limbs. The alternating currents in the primary winding and in the two alternating current windings are coupled to first and second alternating current magnetic fluxes assisting each other in the center limb and respectively flowing in two closed magnetic circuits defined, on the one hand, by the center limb and one outer limb, and, on the other hand, by the center limb and the other outer limb. The transformer supplies the external load with electric energy from the source while regulating the source and supply voltages.

27 Claims, 5 Drawing Sheets

SELF-REGULATED TRANSFORMER-INDUCTOR WITH AIR GAPS

BACKGROUND OF THE INVENTION

The present invention relates to a transformer designed to carry out a regulation of voltage by self-controlled absorption of reactive power.

More specifically, the present invention relates to a self-regulated transformer-inductor mounted on the three-limbed magnetic core of the variable inductor described and claimed in Applicant's U.S. Pat. No. 4,620,144 issued on Oct. 28, 1986.

Indeed, the inventors have discovered that by disposing additional windings on the magnetic core of the variable inductor described and claimed in the abovementioned U.S. Pat. No. 4,620,144, one can obtain a voltage regulating apparatus both efficient and autonomous, or a transformer having the ability to supply a load from an alternating current source, for example a capacitive source, while carrying out efficiently and autonomously a regulation of both the voltage of the source and the supply voltage of the load.

SUMMARY OF THE INVENTION

According to the present invention, there is provided a transformer comprising a magnetic core defining a first limb, a second limb, and a third limb each having a first end and a second end. The first ends of the three limbs are interconnected through a first common point of the magnetic core while the second ends of these three limbs are interconnected through a second common point of the magnetic core. The transformer further comprises first winding means, said primary winding means, wound around at least one of the limbs of the magnetic core and supplied with alternating current by a source of electric energy, as well as second winding means also wound around at least one of the limbs of the magnetic core and supplied with an alternating current generated by the source of electric energy. The first and second winding means are so positioned on the magnetic core that the two alternating currents in these first and second winding means are coupled to an alternating current magnetic flux induced in each of the second and third limbs. Control winding means is supplied with direct current and so disposed on the magnetic core that this direct current induces a direct current magnetic flux in each of the second and third limbs. The alternating current and direct current magnetic fluxes in one of the second and third limbs assist each other while the alternating current and direct current magnetic fluxes in the other of the second and third limbs are in opposition with respect to each other. The transformer further comprises means for converting the alternating current in the second winding means into direct current for the supply of the control winding means. The direct current supplying the control winding means has therefore an amplitude which varies with the amplitude of the alternating current in the second winding means for thereby varying the density of the direct current magnetic flux in the second and third limbs and controlling the permeability of these second and third limbs to the alternating current magnetic flux. Secondary winding means are subjected to the alternating current magnetic flux in the second and third limbs, and connected to an electric load for the supply of this load.

Advantageously, the second limb comprises first gap means traversed by the resultant magnetic flux induced in this second limb, while the third limb comprises second gap means traversed by the resultant magnetic flux induced in this third limb.

In accordance with a preferred embodiment of the invention, the current converting means comprises a diode bridge for rectifying the alternating current in the second winding means and for supplying the control winding means with the so rectified current which therefore constitutes the direct current supplying the control winding means. The transformer may further comprise an inductor of fixed value connected in parallel with the second winding means, and/or a current transformer responsive to the alternating current of the second winding means and including a secondary winding with two terminals respectively connected to the input and the output of the diode bridge which are traversed by this alternating current.

In accordance with another preferred embodiment of the invention, the primary winding means is wound around the first limb, the second winding means comprises first and second alternating current windings connected in series and respectively disposed on the second and third limbs, and the control winding means comprises first and second control windings also connected in series and respectively disposed on the second and third limbs. Accordingly, the alternating currents in the primary winding means and in the first and second alternating current windings of the second winding means are coupled to a first alternating current magnetic flux flowing in a closed magnetic circuit defined by the first and second limbs, as well as to a second alternating current magnetic flux flowing in a closed magnetic circuit defined by the first and third limbs, and the direct current in the first and second control windings induces a direct current magnetic flux flowing in a closed magnetic circuit defined by the second and third limbs.

Preferably, the secondary winding means is wound around the first limb and comprises (a) a winding connected to an external load, (b) a winding connected in parallel with the serially interconnected first and second alternating current windings of the second winding means for supplying with alternating current these two alternating current windings, or (c) both a first winding connected to an external load and a second winding connected in parallel with the two alternating current windings of the second winding means.

The primary and secondary winding means may be formed by a single winding provided with a plurality of taps.

The objects, advantages and other features of the present invention will become more apparent upon reading of the following, detailed description of preferred embodiments of the self-regulated transformer-inductor, given for the purpose of exemplification only with reference to the accompanying drawings in which:

DETAILED DESCRIPTION OF THE PREFERRED EMBODIMENTS

Figure 1:
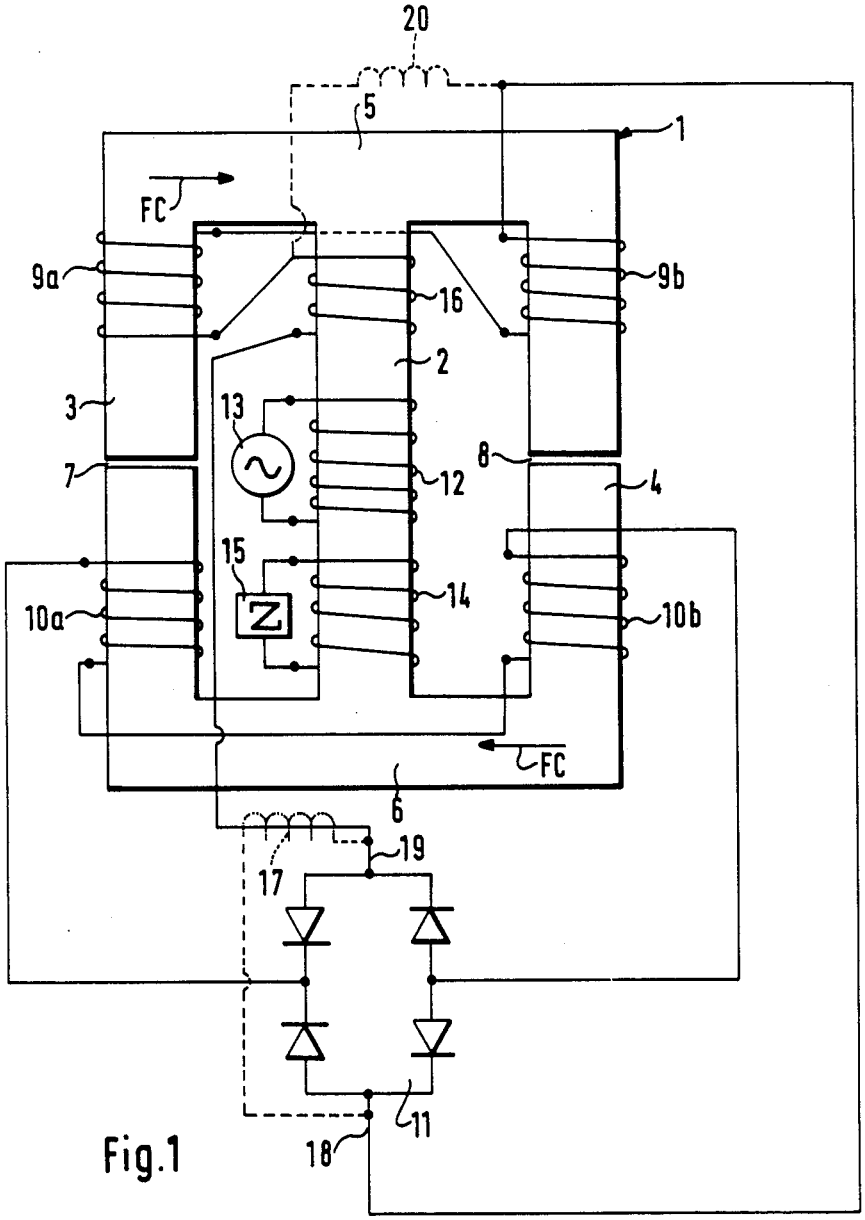
FIG. 1 represents a first embodiment of a self-regulated transformer-inductor with air gaps in accordance with the invention.

It should be first mentioned that in the different Figures of the drawings the same elements are identified by the same reference numerals.

As illustrated in FIG. 1, the self-regulated transformer-inductor with air gaps comprises a three-limbed magnetic core 1 including a center limb 2, and two outer limbs 3 and 4. The upper ends of the limbs 2, 3 and 4 are interconnected through a first common point 5 of the magnetic core 1, while the lower ends of these three limbs 2, 3 and 4 are interconnected through a second common point 6 of the core 1.

It should be noted that in the present disclosure as well as in the appended claims, the term "limb" designates each of the three magnetic circuit paths interconnecting the two common points 5 and 6 of the core 1.

The three limbs 2, 3 and 4 are advantageously of identical cross section. Although it is important that the cross section of the outer limbs 3 and 4 be of a same area, the cross section of the center limb 2 may have an area either equal to or higher than the area of the cross section of the outer limbs 3 and 4.

An air gap 7 is provided at the center of the outer limb 3, while an air gap 8 is provided at the center of the outer limb 4. The air gaps 7 and 8 have identical dimensions.

An alternating current winding 9*a* and a direct current control winding 10*a* are disposed around the outer limb 3, while an alternating current winding 9*b* and a direct current control winding 10*b* are disposed around the outer limb 4. The windings 9*a* and 9*b* are interconnected in series and have a same number of turns. The direct current windings 10*a* and 10*b* are also interconnected in series and have a same number of turns.

A full wave rectifier bridge 11 including a plurality of diodes and constructed in accordance with the usual specifications of the art interconnects the serially interconnected windings 9*a* and 9*b* in series with the serially interconnected windings 10*a* and 10*b*, whereby the alternating current through the windings 9*a* and 9*b* is rectified, and the so rectified current is supplied to the windings 10*a* and 10*b*. It is convenient to call "direct current" the rectified current supplying the windings 10*a* and 10*b*.

The structure of the self-regulated transformer-inductor with air gaps described up to now with reference to FIG. 1 corresponds to the structure of the variable inductor described and claimed in Applicant's U.S. Pat. No. 4,620,144 issued on Oct. 28, 1986.

A primary winding 12 is wound around the center limb 2 and is supplied with alternating current by a source 13 of electric energy. The alternating current in the winding 12 induces in the center limb 2 and alternating current magnetic flux traversing a secondary winding 16 also wound around the center limb 2, whereby the secondary winding 16 generates an alternating current.

The winding 16 has a first terminal connected to the free terminal of the winding 9*a* and a second terminal connected to the alternating current output 19 of the diode bridge 11. Accordingly, the alternating current generated through the secondary winding 16 supplies the serially interconnected windings 9*a* and 9*b*, and is rectified through the diode bridge 11 for supplying the serially interconnected control windings 10*a* and 10*b*.

By appropriately selecting the turn ratio between the windings 12 and 16, the level of the alternating voltage applied to the windings 9*a* and 9*b* can be reduced as desired. Consequently, no external step down transformer is required to achieve this function.

Figure 3:
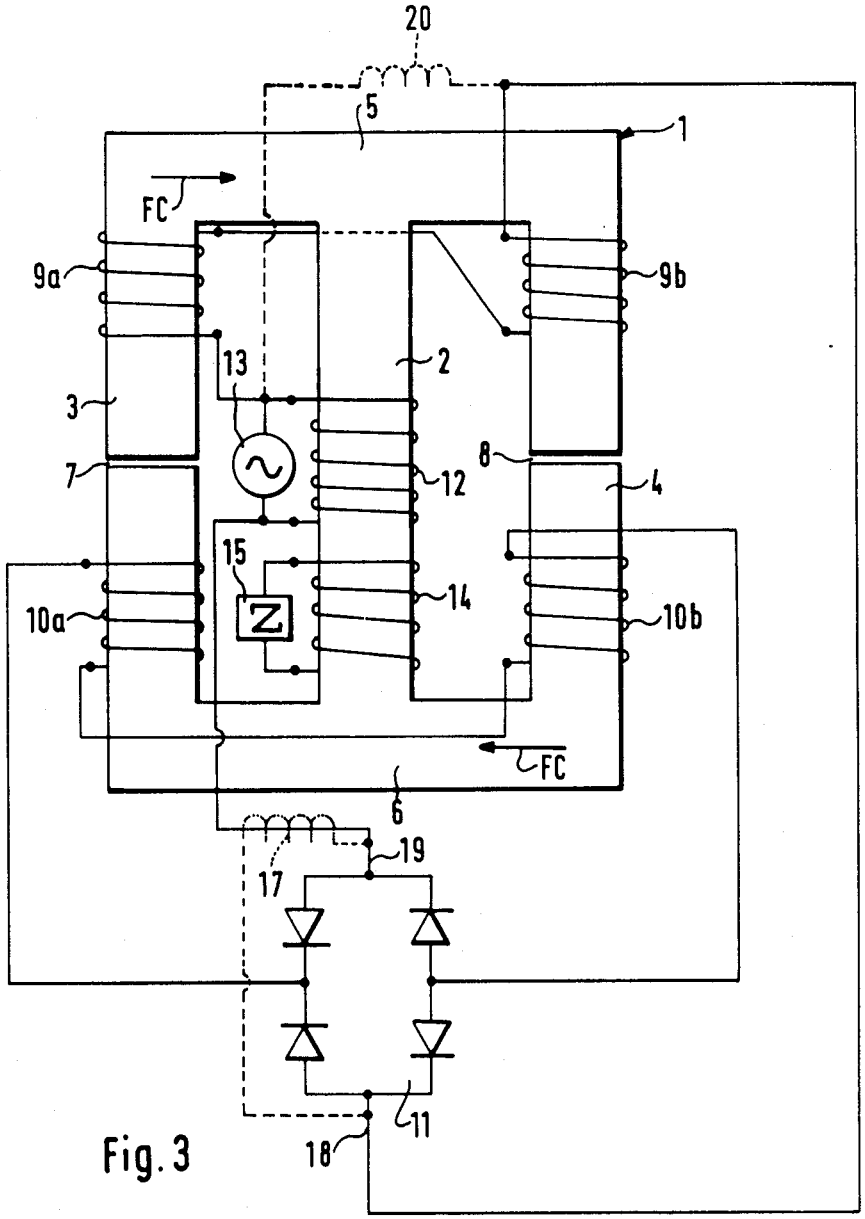
FIG. 3 illustrates a second embodiment of the self-regulated transformer-inductor with air gaps in accordance with the invention.

As illustrated in FIG. 3, the windings 9*a* and 9*b* can be supplied with an alternating current directly from the source 13 when the voltage of this source is of suitable level. In this particular case, a first terminal of the source 13 is connected to the free terminal of the winding 9*a*, while the source 13 has its second terminal connected to the alternating current output 19 of the diode bridge 11. Again, the alternating current supplied by the source 13 to the windings 9*a* and 9*b* is rectified through the diode bridge 11 for supplying the direct current control windings 10*a* and 10*b*.

As shown in FIGS. 1 and 3 of the drawings, the windings 10*a* and 10*b* are so wound around the outer limbs 3 and 4, respectively, and so interconnected that the direct current (rectified current) supplied thereto induces a direct current magnetic flux FC flowing in a closed magnetic circuit defined by the two outer limbs 3 and 4, including of course the air gaps 7 and 8. No direct current magnetic flux flows in the center limb 2.

As also illustrated in FIGS. 1 and 3, the winding 12, the windings 9*a* and 9*b*, and the eventual winding 16 are of the same polarity. The alternating current in the winding 12, and the alternating current in the windings 9*a* and 9*b* and the eventual secondary winding 16 are therefore both coupled to a first alternating current magnetic flux flowing in the closed magnetic circuit defined by the limbs 2 and 3, and to a second alternating current magnetic flux flowing in the closed magnetic circuit defined by the limbs 2 and 4. These first and second alternating current magnetic fluxes assist each other in the center limb 2.

During each positive half-cycle of the alternating current from the source 13, and consequently during each positive half-cycle of the alternating current in the primary winding 12, and of the alternating current in the coils 9*a* and 9*b* and the eventual winding 16, the direct current magnetic flux and the first alternating current magnetic flux in the outer limb 3 are in opposition with respect to each other so that the direct current magnetic flux increases the permeability of the limb 3 to the alternating current flux. On the contrary, the direct current and alternating current magnetic fluxes in the outer limb 4 assist each other, whereby the direct current magnetic flux reduces the permeability of the limb 4 to the second, alternating current magnetic flux.

Of course, the direct current and alternating current magnetic fluxes are superposed as described hereinabove during each positive half-cycle of the alternating current from the source 13. It can be easily appreciated that an inverse phenomenon occurs during each negative half-cycle of the alternating current from the source 13 as in this case, the first and second alternating current magnetic fluxes flow in the opposite direction in the outer limbs 3 and 4.

The function of the direct current magnetic flux FC is to saturate the magnetic core 1 more or less deeply so as to control the permeability of the magnetic core 1 to the first and second alternating current magnetic fluxes. Increase of the direct current magnetic flux FC causes a reduction in the impedance of the windings 9*a*, 9*b* and 12, and an increase of the alternating current in these three windings. The amount of reactive power absorbed by the self-regulated transformer-inductor therefore varies with the direct current magnetic flux FC. As the amplitude of the direct current (rectified current) in the coils 10*a* and 10*b*, and consequently the density of the direct current magnetic flux FC vary automatically and proportionally with the amplitude of the alternating current in the coils 9*a* and 9*b*, a self-control of the permeability to alternating current magnetic flux of the magnetic core 1 and therefore a self-control of the reactive power absorbed by the transformer according to the invention are carried out.

As will be explained in more detail in the following description, the self-controlled absorption of reactive power by the transformer enables, within a given range of source currents, regulation of the alternating voltage across the serially interconnected windings 9*a* and 9*b* and consequently of the alternating voltage of the source 13 at a given level, which level can be adjusted through appropriate adjustment of the parameters of the self-regulated transformer-inductor with air gaps.

Another secondary winding 14 wound around the center limb 2 is responsive to the resultant alternating current magnetic flux in the limb 2 to produce an alternating current supplied to an external load 15. The level of the voltage supplied to the load 15 connected between the terminals of the secondary winding 14 is of course determined by the ratio of the number of turns of the primary and secondary windings 12 and 14. As the alternating voltage of the source 13 is regulated, the alternating supply voltage of the load 15 between the terminals of the winding 14 is therefore also automatically regulated.

Figure 2:
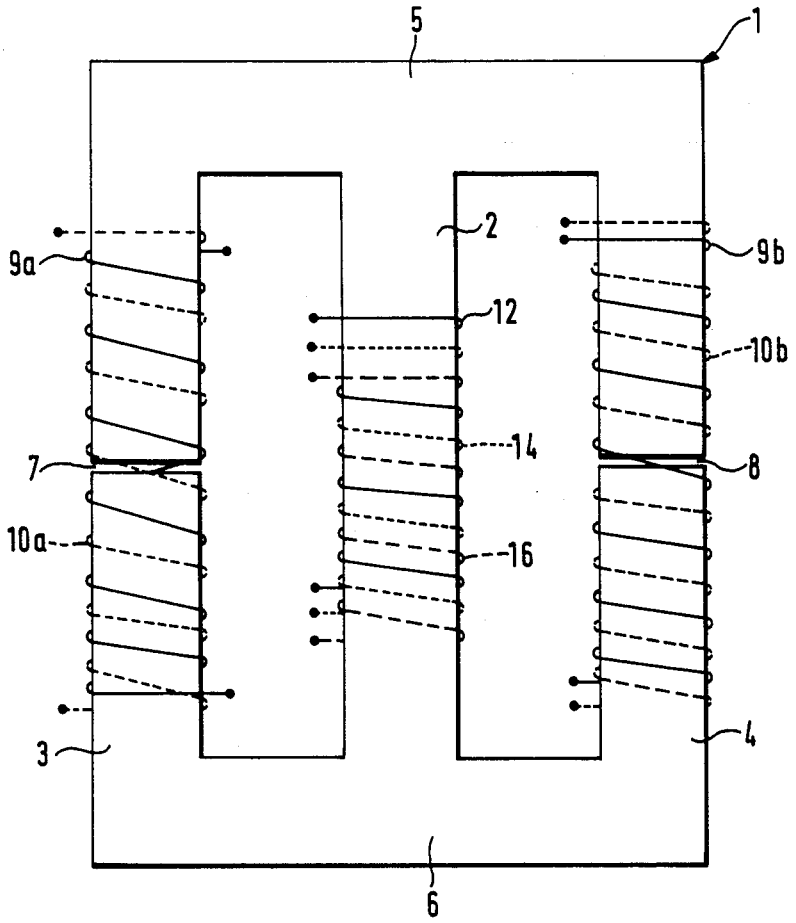
FIG. 2 illustrates a superimposition of windings on the three limbs of the magnetic core of the transformer of FIG. 1.

As illustrated in FIG. 2, the coils 9*a* and 10*a* are so superposed on the outer limb 3 that the air gap 7 is located in the center thereof. Accordingly, the coils 9*b* and 10*b* are also so superposed on the outer limb 4 that the air gap 8 is located in the center thereof. Such a disposition of the coils 9*a*, 9*b*, 10*a* and 10*b* on the limbs 3 and 4 has the advantage of considerably reducing the leakage magnetic fluxes in the region of the air gaps 7 and 8.

The windings 12, 14 and 16 disposed around the center limb 2 can also advantageously be superposed as illustrated in FIG. 2 of the drawings.

Figure 4:
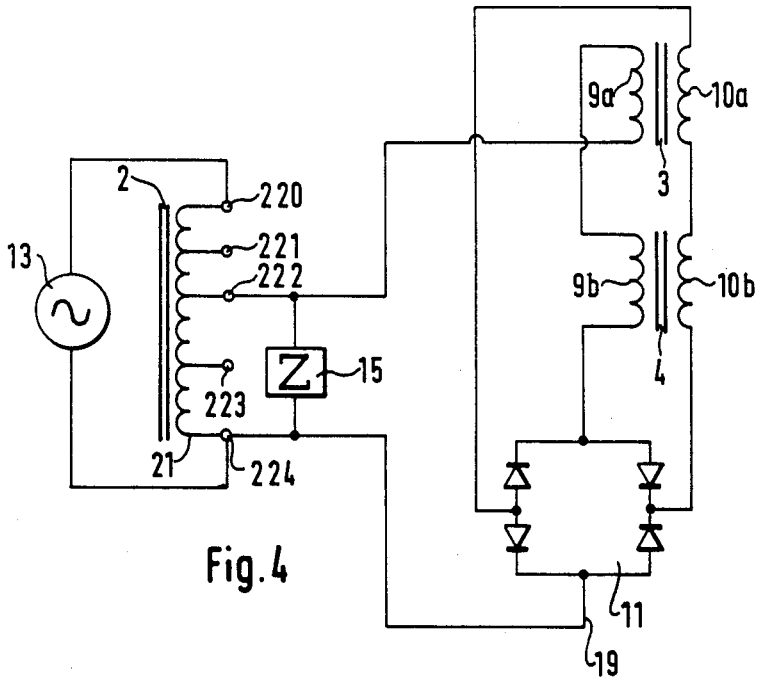
FIG. 4 represents the equivalent circuit of a third embodiment of the self-regulated transformer-inductor according to the invention.

In one embodiment, the windings 12, 14 and 16 of the center limb 2 can be replaced, as illustrated under the form of equivalent circuit in FIG. 4 of the drawings, by a single winding 21 provided with a plurality of taps 220 to 224. The winding 21 is disposed around the center limb 2 and supplied through its taps 220 and 224 with alternating voltage and current by the source of electric energy 13. The windings 9*a* and 9*b* are supplied with alternating current through the taps 222 and 224 of the winding 21. As already described, the electric current in the windings 9*a* and 9*b* is rectified by the diode bridge 11 for supplying the control windings 10*a* and 10*b*. The load 15 is supplied with an alternating current by the winding 21 through the taps 222 and 224. The transformer of FIG. 4 therefore operates as an autotransformer.

The use of a single winding 21 considerably reduces the quantity of electrically conducting wire necessary for the construction of the transformer. Moreover, the diameter of the electrically conducting wire can also be reduced in certain types of circuit.

Certain characteristics of the operation of the self-regulated transformer-inductor with air gaps will now be described by means of the curves of FIG. 6. These curves have been plotted from measurements obtained with the circuit of FIG. 5.

Figure 5:
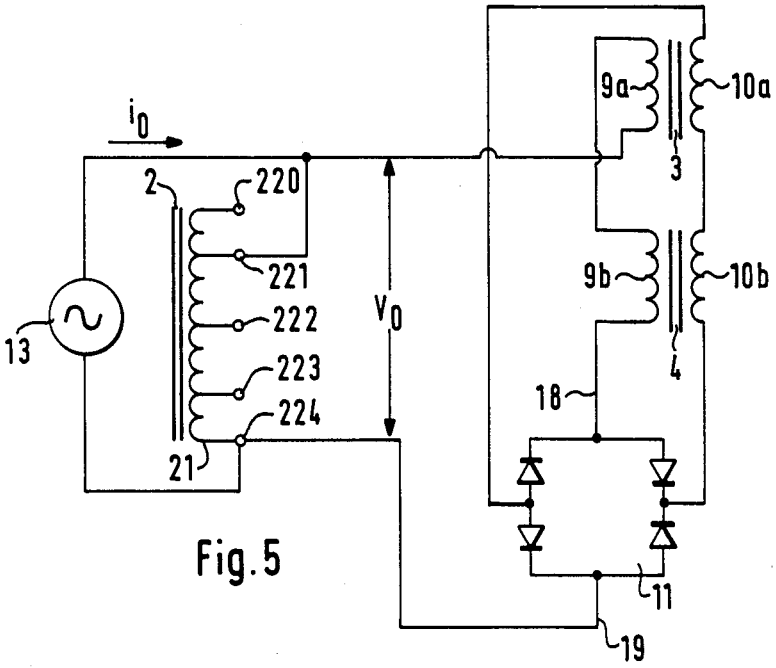
FIG. 5 is the equivalent circuit of a self-regulated transformer-inductor with air gaps used to demonstrate the operation of the present invention.

As in the case of FIG. 4, the circuit of FIG. 5 comprises a winding 21 wound around the center limb 2 and provided with taps 220 to 224. The source 13 is connected between the taps 221 and 224 of the winding 21, and the windings 9*a* and 9*b* are supplied with alternating current directly from the source 13. More specifically, a first terminal of the source 13 is connected to the free terminal of the coil 9*a*, while the second terminal of the source 13 is connected to the alternating current output 19 of the diode bridge 11.

First of all, it should be mentioned that the self-regulated transformer-inductor according to the invention is a one-magnetic-core apparatus performing three functions:

as the self-controlled variable inductor with air gaps described and claimed in the above-mentioned U.S. Pat. No. 4,620,144, it has the ability to absorb a great quantity of reactive power from the source 13 in response to a low increase of the source voltage from a certain pre-established voltage level (see FIG. 7). The so absorbed reactive power is substantially proportional to the increase in source voltage and varies to carry out regulation of the voltage from the source 13;

when used as a transformer, it can supply a desired voltage to external loads such as 15 through a secondary winding such as 14 or 21. As the voltage of the source 13 is regulated through absorption of reactive power as described hereinabove, the voltage supplying the load is also regulated; and when a secondary winding 16 is provided, or when an autotransformer circuit (winding 21) is used, the internal load constituted by the windings 9*a* and 9*b* can be supplied with a voltage lower than the voltage from the source 13. Such a supply method can be economically interesting due to the high costs associated with the electrical insulation and purchase of high voltage diodes for use in the rectifier bridge 11.

However, it should be pointed out that the operation of the self-regulated transformer-inductor with air gaps according to the invention is different from that of a conventional transformer supplying through its secondary winding a self-controlled variable inductor with air gaps as described and claimed in the above-mentioned U.S. Pat. No. 4,620,144. Indeed, the transformer portion for example the primary 12 and secondary 14 windings, and eventually the secondary winding 16, and the variable inductor portion, namely the windings 9*a*, 9*b*, 10*a* and 10*b*, are mounted on a same magnetic core, the core 1, and consequently influence each other through the first and second alternating current magnetic fluxes flowing in the magnetic core 1. Accordingly, the mathematical expressions representative of the characteristics of operation of the transformer are also modified.

First of all, the level of the operating voltage $V_o$ of the transformer, identified in FIG. 5, depends on the ratio between the number of turns of each winding 9a and 9b, and the number of turns of the secondary winding 16 in the case of FIG. 1, on the ratio between the number of turns of each winding 9a and 9b and the number of turns of the primary winding 12 in the case of FIG. 3, on the ratio between the number of turns of each winding 9a and 9b and the number of turns of the portion of the winding 21 between the taps 222 and 224 in the case of FIG. 4, and on the ratio between the number of turns of each winding 9a and 9b and the number of turns of the portion of the winding 21 between the taps 221 and 224 in the case of FIG. 5. Moreover, this relationship between the level of the operating voltage $V_o$ and the above turn ratio is not linear.

Figure 6:
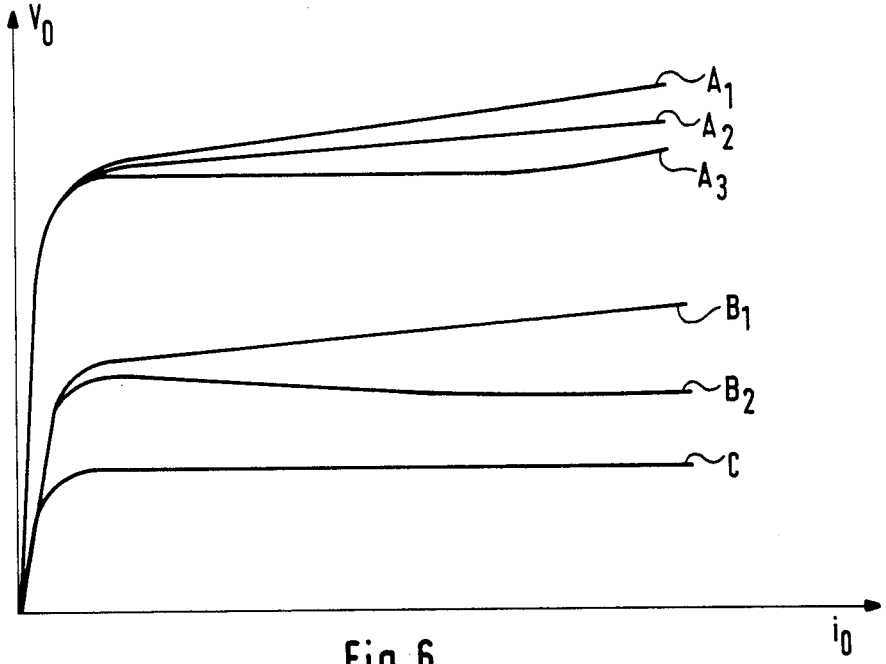
FIG. 6 represents curves of operation of the transformer according to the invention obtained with the circuit of FIG. 5.

FIG. 6 illustrates some curves demonstrating in particular this variation of the level of the operating voltage $V_o$ in function of the above defined turn ratio. It should be noted that the curves of FIG. 6 represent the operating voltage $V_o$ versus the source current $i_o$ (see FIG. 5).

Table 1 hereinunder indicates for each curves of FIG. 6 the number of turns $N_{21}$ between the taps 221 and 224 of the winding 21 of FIG. 5, the number of turns $N_9$ of each winding 9a and 9b, and the number of turns $N_{10}$ of each winding 10a and 10b.

TABLE 1

| Curve | $N_{21}$ | $N_9$ | $N_{10}$ |
|---|---|---|---|
| $A_1$ | 60 | 60 | 64 |
| $A_2$ | 60 | 60 | 66 |
| $A_3$ | 60 | 60 | 67 |
| $B_1$ | 60 | 50 | 54 |
| $B_2$ | 60 | 50 | 56 |
| C | 60 | 40 | 46 |

It can be readily noted from the curves of FIG. 6 and from Table 1 that the level of the operating voltage $V_o$ of the self-regulated transformer-inductor with air gaps can be adjusted by varying the number of turns $N_9$ with respect to the number of turns $N_{21}$. Indeed, the number of turns $N_{21}$ (60 turns) is kept constant for all the curves, while the number of turns $N_9$ is 60 in the case of the curves $A_1$, $A_2$ and $A_3$, 50 in the case of the curves $B_1$ and $B_2$, and 40 in the case of the curve C. FIG. 6 of the drawings further clearly demonstrates the non-linear variation of the level of the operating voltage $V_o$ in function of the turn ratio $N_9/N_{21}$.

Two sets of curves of FIG. 6, namely the set formed by the curves $A_1$, $A_2$ and $A_3$ and the set formed by the curves $B_1$ and $B_2$, and Table 1 demonstrate that when the number of turns $N_{21}$ and $N_9$ are kept constant, variation of the number of turns $N_{10}$ modifies the slope of the curve of operation $V_o$ versus $i_o$ in the region of voltage regulation. It can moreover be easily appreciated that this slope is very sensitive to variation of the turn ratio $N_{10}/N_9$.

Although it can also be theoretically demonstrated, the curves of FIG. 6 readily and clearly demonstrate that in the region of voltage regulation, the level of the operating voltage $V_o$ is function of the ratio $N_9/N_{21}$ and the slope of the curve $V_o$ versus $i_o$ is function of the ratio $N_{10}/N_9$. As the primary winding 21 and the alternating current windings 9a and 9b are mounted on the same magnetic core 1, they influence each other whereby the ratio $N_9/N_{21}$ influences the level of the operating voltage $V_o$.

By appropriately adjusting the ratios $N_9/N_{21}$ and $N_{10}/N_9$, a slope of the curve $V_o$ versus $i_o$ equal to zero can be obtained in the region of voltage regulation, and the operating voltage $V_o$ in this region of voltage regulation can also be adjusted at the desired level.

In order to prevent saturation of the center limb 2 of the magnetic core 1, it has been noted that the area $S_2$ of the cross section of the limb 2, the number of turns $N_{21}$, the area $S_{3,4}$ of the cross section of each of the outer limbs 3 and 4, and the number of turns $N_9$ must satisfy the following relationship:

$$N_{21} \cdot S_2 \geqq N_9 \cdot S_{3,4}.$$

Therefore, when the limbs 2, 3 and 4 have a cross section of same area, the ratio $N_9/N_{21}$ must be lower than or equal to 1.

The operation of the self-regulated transformer-inductor with air gaps is therefore different from that of the self-controlled variable inductor with air gaps described and claimed in Applicant's U.S. Pat. No. 4,620,144 issued on Oct. 28, 1986.

However, as in the case of this variable inductor, the air gaps 7 and 8 of the magnetic core 1 of the transformer uniform the characteristics of operation of transformers constructed in accordance with the invention, as the air gaps 7 and 8 considerably reduce the sensitivity of these characteristics of operation to the disparities in the different magnetic cores of these transformers and to other undesirable phenomenons discussed in detail in the above-mentioned U.S. Pat. No. 4,620,144.

It is of course possible to carry out on the transformer in accordance with the present invention the adjustments of operation described in detail in U.S. Pat. No. 4,620,144 issued on Oct. 28, 1986.

However, the present invention further proposes the following additional means for adjusting the characteristics of operation of the self-regulated transformer-inductor with air gaps.

In accordance with a first alternative, an inductor 20 of fixed value is connected in parallel with the serially interconnected windings 9a and 9b (FIGS. 1 and 3). An alternating current generated by the source 13 and having an amplitude depending on the inductance value of the inductor 20 flows through this inductor. Such a current is rectified and the so rectified current is injected in the windings 10a and 10b. A biasing direct current magnetic flux is thereby produced and flows through the closed magnetic circuit defined by the outer limbs 3 and 4, this biasing magnetic flux and the direct current magnetic flux generated by the rectified alternating current from the windings 9a and 9b assist each other. By varying the inductance value of the inductor 20, the level of the operating voltage $V_o$, in the region of voltage regulation, can be accurately adjusted. The inductor 20 operates linearly or is over excited (susceptible of saturation).

Another alternative consists in using a current transformer 17 (FIGS. 1 and 3) comprising a secondary winding provided with a first terminal connected to the alternating current input 18 of the diode bridge 11 and with a second terminal connected to the alternating current output 19 of the diode bridge 11. The current transformer 17 produces through its secondary winding and in response to the alternating current supplying the windings 9a and 9b an alternating current which is rectified by the diode bridge 11 and supplied to the windings 10a and 10b to generate a biasing direct current magnetic flux flowing in the closed magnetic circuit defined by the outer limbs 3 and 4 in the same direction as the direct current magnetic flux generated by the rectified current from the windings 9a and 9b. As the current produced by the transformer 17 has an amplitude which varies with the value of the current in the windings 9a and 9b, the biasing direct current magnetic flux varies accordingly. The slope of the curve $V_o$ versus $i_o$ in the region of voltage regulation can be adjusted, i.e. either increased or reduced, by selecting a transformer 17 with the appropriate characteristics.

Of course, in order to adjust the characteristics of operation of the self-regulated transformer-inductor with air gaps as desired, the inductor 20 and the transformer 17 can be simultaneously used.

Figure 7:
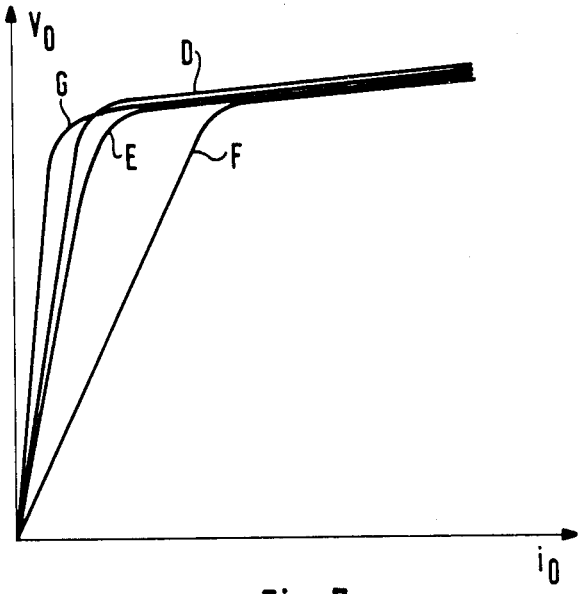
FIG. 7 represents a series of curves representative of the operation of a transformer in accordance with the invention in function of the load supplied through such a transformer.

FIG. 7 illustrates the operation of a transformer according to the invention when different loads are connected between the terminals of the secondary winding, for example the winding 14.

More specifically, curve G of FIG. 7 corresponds to the curve $V_o$ versus $i_o$ when the transformer supplies no load (no load condition). The curves D, E and F correspond to the operation of the transformer when supplying a load with electric power from a source, the load corresponding to the curve F being greater than the load corresponding to the curve E, and the load corresponding to the curve E being greater than the load corresponding to the curve D. In the region of voltage regulation, the voltage $V_o$ remains relatively constant as the load varies, even when the transformer supplies no load (curve G).

One skilled in the art can appreciate that the self-regulated transformer-inductor with air gaps constitutes a simple apparatus of regulation of alternating voltage by self-controlled absorption of reactive power.

A very interesting application of the self-regulated transformer-inductor with air gaps is, as in the case of the variable inductor of the above-mentioned U.S. Pat. No. 4,620,144, the regulation of the alternating voltage applied to an electric load supplied by overhead wire, or more generally by a capacitive source (capacitive coupling).

In such an application, the capacitive source constitutes the source 13. The load can be resistive, reactive or both resistive and reactive. As demonstrated by FIG. 7 of the drawings, the transformer according to the invention supplies to the load the required power while maintaining the voltage $V_o$ and consequently the voltage supplied to the load at a relatively constant level.

When used for supplying a load with the electric energy from a capacitive source (through a capacitive coupling), the internal electric losses of the self-regulated transformer-inductor with air gaps do no increase with the alternating current supplied to this load. Indeed, when the current supplied to the load by the transformer according to the invention increases, the alternating current in the windings 9a and 9b, and therefore the direct current in the windings 10a and 10b both reduce.

Although the present invention has been described hereinabove by means of preferred embodiments of the self-regulated transformer-inductor with air gaps, it should be noted that any modification to these emdodiments as well as any other application of the transformer can be carried out within the scope of the appended claims, without changing or altering the nature and scope of the present invention.

What is claimed is:

1. A self-regulated transformer-inductor comprising:

a magnetic core defining a first limb, a second limb, and a third limp each having a first end and a second end, said first ends being interconnected through a first common point of the magnetic core and said second ends being interconnected through a second common point of said magnetic core;

transformer means including primary winding means wound around at least one of said limbs of the magnetic core and supplied with alternating current by a source of electric energy; and variable inductor means including second winding means different from said primary winding means, wound around at least one of said limbs of the magnetic core, and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

said variable inductor means also including control winding means supplied with direct current and so disposed on the magnetic core that the said direct current current induces a direct current magnetic flux in each of said second and third limbs;

the alternating current and direct current magnetic fluxes in one of the second and third limbs assisting each other while the alternating current and direct current magnetic fluxes in the other of said second and third limbs are in opposition with respect to each other;

said varaible inductor means further comprising means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux; and said transformer means also including secondary winding means subjected to the alternating current magnetic flux in said second and third limbs, and connected to an electric load for the supply of said load.

2. A transformer comprising:

a magnetic core defining a first limb, a second limb, and a third limb each having a first end and a second end, said first ends being interconnected through a first common point of the magnetic core and said second ends being interconnected through a second common point of said magnetic core;

primary winding means wound around at least one of said limbs of the magnetic core and supplied with alternating current by a source of electric energy;

second winding means also wound around at least one of said limbs of the magnetic core and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

control winding means supplied with direct current and so disposed on the magnetic core that the said direct current induces a direct current magnetic flux in each of said second and third limbs;

the alternating current and direct current magnetic fluxes in one of the second and third limbs assisting each other while the alternating current and direct current magnetic fluxes in the other of said second and third limbs are in opposition with respect to each other;

means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux;

secondary winding means subjected to the alternating current magnetic flux in said second and third limbs, and connected to an electric load for the supply of said load; and the second limb comprising gap means traversed by the resultant magnetic flux in said second limb, and the third limb also comprising gap means traversed by the resultant magnetic flux in said third limb.

3. A transformer according to claim 2, wherein said current converting means comprises a diode bridge for rectifying the alternating current supplying the second winding means and for supplying the so rectified current to the control winding means, the rectified current constituting the direct current supplying the control winding means.

4. A transformer according to claim 3, further comprising an inductor connected in parallel with said second winding means.

5. A transformer according to claim 3, wherein said diode bridge comprises an input and an output traversed by the alternating current supplying the second winding means, and wherein said transformer further comprises a current transformer subjected to the alternating current in the second winding means and comprising a secondary winding provided with first and second terminals respectively connected to said input and output of the diode bridge.

6. A transformer according to claim 2, wherein said primary winding means is disposed on the first limb and has a number of turns $N_P$, the second winding means comprises first and second windings disposed on the second and third limbs, respectively, connected in series and each comprising a number of turns $N_S$, the first limb has a cross section of area $S_1$, and the second and third limbs each have a cross section of area $S_{23}$, the parameters $N_P$, $N_S$, $S_1$ and $S_{23}$ satisfying the following relationship:

$$N_P \cdot S_1 \geqq N_S \cdot S_{23}.$$

7. A transformer comprising:

a magnetic core defining a first limb, a second limb, and a third limb each having a first end and a second end, said first ends being interconnected through a first common point of the magnetic core and said second ends being interconnected through a second common point of said magnetic core;

primary winding means wound around at least one of said limbs of the magnetic core and supplied with alternating current by a source of electric energy;

second winding means also wound around at least one of said limbs of the magnetic core and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

control winding means supplied with direct current and so disposed on the magnetic core that the said direct current induces a direct current magnetic flux in each of said second and third limbs;

the alternating current and direct current magnetic fluxes in one of the second and third limbs assisting each other while the alternating current and direct current magnetic fluxes in the other of said second and third limbs are in opposition with respect to each other;

means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux;

secondary winding means subjected to the alternating current magnetic flux in said second and third limbs, and connected to an electric load for the supply of said load; and said primary and secondary winding means being formed by a single winding mounted on said first limb and comprising a plurality of taps.

8. A transformer comprising:

a magnetic core defining a first limb, a second limb, and a third limb each having a first end and a second end, said first ends being interconnected through a first common point of the magnetic core and said second ends being interconnected through a second common point of said magnetic core;

primary winding means wound around at least one of said limbs of the magnetic core and supplied with alternating current by a source of electric energy;

second winding means also wound around at least one of said limbs of the magnetic core and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

control winding means supplied with direct current and so disposed on the magnetic core that the said direct current induces a direct current magnetic flux in each of said second the third limbs;

the alternating current and direct current magnetic fluxes in one of the second and third limbs assisting each other while the alternating current and direct current magnetic fluxes in the other of said second and third limbs are in opposition with respect to each other;

means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux;

secondary winding means subjected to the alternating current magnetic flux in said second and third limbs, and connected to an electric load for the supply of said load; and said primary winding means being disposed on the first limb and having a number of turns $N_P$, the second winding means comprising first and second windings disposed on the second and third limbs, respectively, connected in series and each comprising a number of turns $N_S$, the first limb having a cross section of areas $S_1$, the second and third limbs each having a cross section of the area $S_{23}$, and the parameters $N_P$, $N_S$, $S_1$ and $S_{23}$ satisfying the following relationship:

$$N_P \cdot S_1 \geqq N_S \cdot S_{23}.$$

9. A transformer comprising:

a magnetic core defining a first limb, a second limb and a third limb each having a first end and a second end, said first ends being interconnected through a first common point of the magnetic core and said second ends being interconnected through a second common point of said magnetic core;

primary winding means wound around said first limb and supplied with alternating current by a source of electric energy;

second winding means wound around at least one of said limbs of the magnetic core and supplied with an alternating current generated by said source;

said alternating currents in the primary and second winding means being coupled to a first alternating current magnetic flux flowing in a closed magnetic circuit defined by the first and second limbs and to a second alternating current magnetic flux flowing in a closed magnetic circuit defined by the first and third limbs, the first and second alternating current magnetic fluxes assisting each other in the first limb;

a first control winding and a second control winding wound around the second and third limbs, respectively, said first and second control windings being so connected in series and supplied with direct current that the said direct current induces a direct current magnetic flux flowing in a closed magnetic circuit defined by the second and third limbs;

means for converting the alternating current in the second winding means into direct current for the supply of the first and second control windings, the direct current supplying the control windings having an amplitude which varies with the amplitude of the alternating current in the second winding means to thereby vary the density of said direct current magnetic flux and controlling the permeability of the second and third limbs to the first and second alternating current magnetic fluxes, respectively; and secondary winding means wound around said first limb, subjected to the first and second alternating current magnetic fluxes which assist each other in the first limb, and connected to an electric load for the supply of said load.

10. A transformer according to claim 9, wherein said second limb comprises first gap means traversed by the resultant magnetic flux in said second limb, and wherein the third limb comprises second gap means traversed by the resultant magnetic flux in said third limb.

11. A transformer according to claim 10, wherein said second winding means comprises a first alternating current winding and a second alternating current winding connected in series and disposed around the second and third limbs, respectively.

12. A transformer according to claim 11, wherein said load is an external load and wherein said transformer further comprises additional secondary winding means wound around said first limb and provided with two terminals between which the first and second alternating current windings of the second windings means are connected in series, said additional secondary winding means generating the alternating current supplying the first and second windings of the second winding means in response to the resultant magnetic flux induced in said first limb.

13. A transformer according to claim 12, wherein said primary winding means, and said two secondary winding means are formed by a single winding disposed around said first limb and comprising a plurality of taps.

14. A transformer according to claim 12, wherein said additional secondary winding means supplying with alternating current the first and second alternating current windings of the second winding means has a number of turns $N_S$, each of the first and second alternating current windings of the second winding means has a number of turns $N_A$, the first limb has a cross section of area $S_1$and the second and third limbs each have a cross section of area $S_{23}$, which satisfy the following relationship:

$$N_S \cdot S_1 \geqq N_A \cdot S_{23}.$$

15. A transformer according to claim 11, wherein said current converting means comprises a diode bridge for rectifying the alternating current supplying the second winding means, and for supplying the so rectified current to the first and second control windings, the rectified current constituting the direct current supplying the first and second control windings.

16. A transformer according to claim 15, further comprising an inductor connected in parallel with the serially interconnected first and second windings of the second winding means.

17. A transformer according to claim 15, wherein said diode bridge comprises an input and an output traversed by the alternating current supplying the first and second windings of the second winding means, and wherein said transformer further comprises a current transformer responsive to the alternating current in the first and second windings of the second winding means and including a secondary winding provided with first and second terminals respectively connected to said input and output of the diode bridge.

18. A transformer according to claim 11, wherein said first alternating current winding of the second winding means and said first control winding are so superposed around said second limb that the said first gap means is located in the center of said first winding of the second winding means and in the center of said first control winding, wherein said second alternating current winding of the second winding means and said second control winding are so superposed around the third limb that said second gap means is located in the center of said second winding of the second winding means and in the center of said second control winding, and wherein said primary and secondary winding means are superposed around said first limb.

19. A transformer according to claim 10, wherein said current converting means comprises a diode bridge for rectifying the alternating current supplying the second winding means and for supplying the so rectified current to the first and second control windings, the rectified current constituting the direct current supplying the first and second control windings.

20. A transformer according to claim 18, further comprising an inductor connected in parallel with said second winding means.

21. A transformer according to claim 18, wherein the diode bridge comprises an input and an output traversed by the alternating current supplying the second winding means, and wherein said transformer further comprises a current transformer responsive to the alternating current in the second winding means and including a secondary winding provided with first and second terminals respectively connected to said input and output of the diode bridge.

22. A transformer according to claim 10, wherein said primary and secondary winding means are formed by a single winding mounted on said first limb and comprising a plurality of taps.

23. A transformer comprising:

a magnetic core defining a first limb, a second limb and a third limb each having a first end and a second end, said first ends being interconnected through a first common point of the magnetic core and said second ends being interconnected through a second common point of said magnetic core;

a primary winding wound around said first limb and supplied with alternating current by a source of electric energy;

a first alternating current winding and a second alternating current winding disposed around said second and third limbs, respectively, connected in series and supplied with an alternating current generated by said source;

said alternating currents in the primary winding and in the first and second alternating current windings being coupled to a first alternating current magnetic flux flowing in a closed magnetic circuit defined by the first and second limbs and to a second alternating current magnetic flux flowing in a closed magnetic circuit defined by the first and third limbs, said first and second alternating current magnetic fluxes assisting each other in the first limb;

a first control winding and a second control winding disposed around the second and third limbs, respectively, said first and second control windings being connected in series and supplied with direct current to induce a direct current magnetic flux flowing in a closed magnetic circuit defined by the second and third limbs;

means for converting the alternating current supplying the first and second alternating current windings into direct current for the supply of the first and second control windings, the direct current supplying said control windings having an amplitude which varies with the amplitude of the alternating current in the first and second alternating current windings to thereby vary the density of said direct current magnetic flux and controlling the permeability of the second and third limbs to the first and second alternating current magnetic fluxes, respectively; and a secondary winding wound around the first limb and consequently subjected to the first and second alternating current magnetic fluxes which assist each other in said first limb, said secondary winding being provided with two terminals between which the first and second alternating current windings are connected in series, whereby the alternating current in the first and second alternating current windings is supplied to said first and second alternating current windings through the two terminals of the secondary winding.

24. A transformer according to claim 23, wherein said second limb comprises gap means traversed by the resultant magnetic flux in said second limb, and wherein the third limb also comprises gap means traversed by the resultant magnetic flux in said third limb.

25. A transformer according to claim 24, wherein said secondary winding wound around the first limb and subjected to the first and second alternating current magnetic fluxes has a number of turns $N_S$, each of the first and second alternating current windings has a number of turns $N_A$, the first limb has a cross section of area $S_1$, and the second and third limbs each have a cross section of area $S_{23}$, which satisfy the following relationship:

$$N_S \cdot S_1 \geqq N_A \cdot S_{23}.$$

26. A transformer comprising:

a magnetic core defining a first limb, a second limb, and a third limb each having a first end and a second end, said first ends being interconnected through a first common point of the magnetic core and said second ends being interconnected through a second common point of said magnetic core;

primary winding means wound around at least one of said limbs of the magnetic core and supplied with alternating current by a source of electric energy;

second winding means also wound around at least one of said limbs of the magnetic core and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

control winding means supplied with direct current and so disposed on the magnetic core that the said direct current induces a direct current magnetic flux in each of said second and third limbs;

the alternating current and direct current magnetic fluxes in one of the second and third limbs assisting each other while the alternating current and direct current magnetic fluxes in the other of said second and third limbs are in opposition with respect to each other;

means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux; and secondary winding means subjected to the alternating current magnetic flux in said second and third limbs, and connected to an electric load for the supply of said load;

wherein (a) said current converting means comprises a diode bridge for rectifying the alternating current supplying the second winding means and for supplying the so rectified current to the control winding means, the rectified current constituting the direct current supplying the control winding means, and (b) the said transformer further comprises an inductor connected in parallel with said second winding means.

27. A transformer comprising:

a magnetic core defining a first limb, a second limb, and a third limp each having a first end and a second end, said first ends being interconnected through a first common point of the magnetic core and said second ends being interconnected through a second common point of said magnetic core;

primary winding means wound around at least one of said limbs of the magnetic core and supplied with alternating current by a source of electric energy;

second winding means also wound around at least one of said limbs of the magnetic core and supplied with an alternating current generated by said source of electric energy;

said primary and second winding means being so positioned on the magnetic core that the said two alternating currents in the primary and second winding means are coupled to an alternating current magnetic flux induced in each of the second and third limbs;

control winding means supplied with direct current and so disposed on the magnetic core that the said direct current induces a direct current magnetic flux in each of said second and third limbs;

the alternating current and direct current magnetic fluxed in one of the second and third limbs assisting each other while the alternating current and direct current magnetic fluxes in the other of said second and third limbs are in opposition with respect to each other;

means for converting the alternating current in the second winding means into direct current for the supply of the control winding means, the direct current supplying the control winding means having an amplitude which varies with the amplitude of the alternating current in the second winding means for thereby varying the density of the direct current magnetic flux in the second and third limbs and controlling the permeability of said second and third limbs to the alternating current magnetic flux; and secondary winding means subjected to the alternating current magnetic flux in said second and third limbs, and connected to an electric load for the supply of said load;

wherein said current converting means comprises a diode bridge for rectifying the alternating current supplying the second winding means and for supplying the so rectified current to the control winding means, the rectified current constituting the direct current supplying the control winding means, wherein said diode bridge comprises an input and an output traversed by the alternating current supplying the second winding means, and wherein said transformer further comprises a current transformer subjected to the alternating current in the second winding means and comprising a secondary winding provided with first and second terminals respectively connected to said input and output of the diode bridge.

* * * * *